US006746568B1

(12) United States Patent
Terelius et al.

(10) Patent No.: US 6,746,568 B1
(45) Date of Patent: Jun. 8, 2004

(54) TREATMENT OF FILTRATES FROM PEROXIDE BLEACHING OF PULP

(75) Inventors: Hans Terelius, Uttran (SE); Anette Olsson, Helsingborg (SE); Margareta Nilsson, Helsingborg (SE); Jessica Svensson, Helsingborg (SE); Christos Rampotas, Helsingborg (SE)

(73) Assignee: Kemira Kemi AB, Helsingborg (SE)

( * ) Notice: Subject to any disclaimer, the term of this patent is extended or adjusted under 35 U.S.C. 154(b) by 191 days.

(21) Appl. No.: 09/662,801

(22) Filed: Sep. 15, 2000

Related U.S. Application Data

(63) Continuation of application No. PCT/SE99/00568, filed on Apr. 7, 1999.

(30) Foreign Application Priority Data

Apr. 8, 1998 (SE) ..... 9801232

(51) Int. Cl.[7] ..... D21C 9/02; D21C 9/16; D21C 11/00

(52) U.S. Cl. ..... 162/38; 162/41; 162/42; 162/43; 162/45; 162/60; 162/78; 162/79

(58) Field of Search ..... 8/111; 162/78, 162/79, 60, 38, 41, 42, 43, 45

(56) References Cited

U.S. PATENT DOCUMENTS 4,019,952 A 4/1977 Ploetz, deceased et al.
4,218,284 A * 8/1980 Hultman et al. ..... 162/38
4,661,205 A 4/1987 Ow et al.

FOREIGN PATENT DOCUMENTS

EP A1564443 10/1993
GB 1354455 5/1974

OTHER PUBLICATIONS

Hook et al., Conference Literature, (1997).
Gellerstedt et al., Journal of Wood Chemistry and Technology, vol. 2, No. 3, pp. 231–250 (1982).

* cited by examiner

*Primary Examiner*—Steve Alvo
(74) *Attorney, Agent, or Firm*—Birch, Stewart, Kolasch & Birch, LLP

(57) ABSTRACT

A method in bleaching of pulp is described, in which the pulp is subjected to a peroxide bleaching step, whereupon the pulp is washed and the washing liquid from the washing is separated from the pulp in the form of a filtrate. The method is characterised in that the filtrate is treated with an aluminium compound, such as aluminium sulphate or polyaluminium sulphate, for precipitation of interfering substances, such as oxygen-demanding organic material and metals, that the precipitated material is removed from the filtrate, that the aluminium content of the filtrate after precipitation of interfering substances is adjusted to at most 20 ppm, and that the filtrate is then recirculated to the peroxide bleaching step. By the method, a reduced consumption of hydrogen peroxide in the peroxide bleaching step is achieved.

9 Claims, No Drawings

TREATMENT OF FILTRATES FROM PEROXIDE BLEACHING OF PULP

This application is a Continuation of PCT International Application No. PCT/SE99/00568 filed on Apr. 7, 1999, which designated the United States, and on which priority is claimed under 35 U.S.C. § 120, the entire contents of which are hereby incorporated by reference.

FIELD OF THE INVENTION

The present invention relates to a method in bleaching of pulp, and more specifically the invention concerns a method in which the pulp is subjected to a peroxide bleaching step, whereupon the pulp is washed and the washing liquid from the washing is separated from the pulp in the form of a filtrate.

BACKGROUND ART

Pulp, which here relates to cellulose-containing pulp for making paper, is normally subjected to bleaching in order to dissolve lignin and/or increase the brightness of the pulp. The bleaching of pulp is usually carried out in a plurality of steps, such as 4–5 steps when bleaching sulphate pulp or 1–2 steps when bleaching mechanical pulp, and in peroxide bleaching the bleaching is carried out in at least one of these steps with hydrogen peroxide under alkaline conditions. An increasing amount of papermaking pulp is currently bleached by means of hydrogen peroxide. The hydrogen peroxide bleaching can be carried out at atmospheric pressure and a temperature of about 70–100° C. or be pressurised, for instance to a pressure of 5 bar with oxygen, and be carried out at a temperature above 100° C., such as 100–120° C. A conventional peroxide bleaching method for sulphate pulp can comprise, for instance, the following steps: an oxygen step, in which the pulp is treated with oxygen, followed by washing of the pulp before treating it with a complexing agent, such as ethylene diamine tetraacetic acid (EDTA) to complex interfering metal ions, such as iron, manganese, copper, zinc and chromium. The treatment with a complexing agent can be carried out in one or more steps. Subsequently, the pulp is washed and then fed to a peroxide bleaching step, where the pulp is bleached with hydrogen peroxide. After the peroxide bleaching step, the pulp is washed and after separation of the filtrate, this can at least partly be recirculated to the peroxide bleaching step as washing liquid. The various washing steps that occur in connection with the bleaching are generally carried out with a washing liquid (water) which is fed countercurrently to the process flow, i.e. clean washing water is added at the end of the bleaching and is supplied in the direction of the beginning of the bleaching, the washing liquid being successively used to wash more and more contaminated (unbleached) pulp. In this manner, the washing liquid can be utilised optimally.

The efficiency of the hydrogen peroxide in the peroxide bleaching is impaired by interfering substances, such as oxygen-demanding organic material (below referred to as COD material, i.e. chemically oxygen-demanding material) and metal ions, such as manganese, iron, chromium, copper, nickel and zinc (cf. Gellerstedt, G., Pettersson, L., Chemical Aspects of Hydrogen Peroxide Bleaching, Part 2. The bleaching of kraft pulps. Journal of Wood Chemistry and Technology 2 (1982) :3, 231). This means that the hydrogen peroxide must be supplied to the bleaching step in excess to be able to achieve the intended bleaching effect. The negative effect of interfering substances in the peroxide bleaching step increases by recirculation of the filtrate from the washing of the pulp after the peroxide bleaching step by the filtrate containing interfering substances from the peroxide bleaching step, and in continued recirculation of the filtrate an increasing amount of interfering substances is collected in the filtrate. Thus, hydrogen peroxide must normally be added to the bleaching step in a great excess, and it is as a rule estimated that about 40% of the charged hydrogen peroxide is consumed for bleaching while about 40% decomposes owing to the presence of interfering substances (cf. J. Hook and U. Ekholm, "Microcalorimetry—a New Tool to Study Hydrogen Peroxide Reactions", 9th International Symposium on Wood and Pulping Chemistry: 1997). This means that the filtrate which is obtained after washing and dewatering of the pulp after the peroxide bleaching step contains only about 20% of remaining hydrogen peroxide together with oxygen-demanding organic material.

THE INVENTION

In the present invention, it has now surprisingly been found that the problem of undesirable decomposition of hydrogen peroxide in the peroxide bleaching step can be significantly reduced by treating the filtrate from the dewatering of the pulp after the peroxide bleaching step with an aluminium compound for precipitation of interfering substances, such as COD material, before the filtrate is recirculated to the peroxide bleaching step.

More specifically, the present invention provides a method in bleaching of pulp, in which the pulp is subjected to a peroxide bleaching step, whereupon the pulp is washed and the washing liquid from the washing is separated from the pulp in the form of a filtrate, characterised in that the filtrate is treated with an aluminium compound for precipitating interfering substances, that the precipitated material is removed from the filtrate, that the aluminium content of the filtrate after precipitation of interfering substances is adjusted to at most 20 ppm, and that the filtrate is then recirculated to the peroxide bleaching step.

Further features and advantages of the invention are evident from the following description and the appended claims.

DETAILED DESCRIPTION OF THE INVENTION

By the expression "pulp" used in the context is meant a cellulose-containing pulp for making paper, said pulp comprising mechanical pulp as well as semichemical and chemical pulp, such as sulphate pulp and sulphite pulp.

By the expression "peroxide bleaching" which is used in the context is meant bleaching with an alkali peroxide or, preferably, hydrogen peroxide as the bleaching chemical.

The aluminium compound which is used for treatment of the filtrate is not particularly critical and can be selected among a large number of different aluminium compounds, such as those known as flocculating or precipitating agents in connection with the purification of drinking water and waste water. As specific examples of usable aluminium compounds mention can be made of aluminium chloride, aluminium nitrate, aluminium sulphate, as well as polyaluminium compounds, such as polyaluminium chloride, polyaluminium nitrate and polyaluminium sulphate. Of these, however, aluminium chloride is less preferred since it may cause corrosion. Particularly preferred aluminium compounds are aluminium sulphate, polyaluminium nitrate and polyaluminium sulphate.

The amount of aluminium compound which is added to the filtrate should at least be sufficient to reduce and, if possible, essentially eliminate interfering substances, such as oxygen-demanding organic material (COD material) as well as metals, by precipitation from the filtrate. In general terms, this means an addition of about 1–6000 mg Al/kg of pulp, preferably 1000–4000 mg Al/kg of pulp, more preferred 1500–3500 mg Al/kg of pulp, and most preferred about 2500 mg Al/kg of pulp. This corresponds generally to about ca 1–600 mg (ppm) Al/l of filtrate, preferably 100–400 mg Al/l of filtrate, more preferred 150–350 mg Al/l of filtrate, and most preferred about 250 mg Al/l of filtrate.

The aluminium compound used for precipitation should, especially if it contains aluminium in loosely bound/dissociable form, not be added in such an excess that considerable amounts of non-reacted aluminium compound, after removal of precipitated material from the filtrate, accompany the filtrate to the peroxide bleaching step. It has, in fact, been established in the invention that the aluminium compound used for the precipitation can have a negative effect on the peroxide bleaching so that the consumption of peroxide increases. The aluminium compound is added in such an amount that the filtrate after removal of precipitated material contains at most about 20 ppm Al, preferably at most about 10 ppm Al, more preferred at most about 7 ppm Al.

To prevent an undesirable excess of the aluminium compound from accompanying the filtrate to the peroxide bleaching step, an undesirable excess of the aluminium compound can, after the precipitation of interfering substances, be precipitated as a sparingly soluble aluminium compound.

The temperature in the treatment of the filtrate with the aluminium compound is not particularly critical, and the treatment is normally carried out at the temperature that the filtrate has after washing of the pulp from the peroxide bleaching step. This temperature is usually in the range 60–100° C., preferably 70–90° C.

The treatment of the filtrate with the aluminium compound can be carried out within a wide pH range. As a rule, however, the pH should be in the range 4–11, preferably 5–7 with regard to good precipitation and flocculation of interfering substances, such as organic oxygen-demanding material (COD) and metals, and to the fact that the pH in the peroxide bleaching preferably is in the range 8–11, more preferred 9–11. If necessary, the pH of the filtrate can be adjusted, the adjustment suitably being effected by using an alkali, such as sodium hydroxide, or an acid, such as sulphuric acid.

According to the invention, the treatment of the filtrate with the aluminium compound is suitably carried out in such manner that the desired amount of aluminium compound is added to the filtrate under agitation so that the aluminium compound is distributed uniformly in the filtrate for precipitation and flocculation of interfering substances. For the precipitation to be optimal, the aluminium compound should be given sufficient time to act before the formed precipitate is separated from the filtrate, for instance by filtration. Suitably a time from about 1 s to about 30 min, preferably about 1–5 min, should be allowed to pass from the addition of the aluminium compound to the separation of the precipitate.

With a view to facilitating the flocculation, a flocculating aid in the form of a polymer can be added. Such flocculating aids are well known to those skilled in the art and comprise, for instance, polyacrylamide.

After treatment of the filtrate with an aluminium compound and separation of the formed precipitate, the filtrate is recirculated to the peroxide bleaching step. This recirculation or reuse of the filtrate in the peroxide bleaching step is carried out by the filtrate being supplied countercurrently to the process flow and being used as the washing liquid for washing of pulp in a washing step preceding the peroxide bleaching step.

Owing to the separation of the formed precipitate, the filtrate contains fewer substances that have a detrimental effect on the peroxide bleaching, and the recirculation of the filtrate to the peroxide bleaching step can therefore be increased compared with the recirculation of filtrate in a conventional peroxide bleaching method.

By the filtrate being purified, the hydrogen peroxide content in the peroxide bleaching should be affected positively, i.e. the filtrate in the washing of the pulp after the peroxide bleaching step should contain a higher remaining peroxide content than according to conventional technique. This condition has also been established, but in the invention also an unexpected effect which has not been explained until now has been established, which means that the remaining amount of peroxide in the filtrate after the peroxide bleaching step is further increased. This is supposed to be due to the fact that in the filtrate treated with the aluminium compound, small amounts of another, aluminium-containing compound form, which is capable of binding metal ions, such as manganese, so that they cannot have any peroxide-decomposing effect in the peroxide bleaching step. By small amounts is here meant amounts in the order of at most 20 ppm Al, such as 0.01–20 ppm Al, preferably 0.01–10 ppm Al, more preferred 0.01–7 ppm Al. During the bleaching step, the aluminium in the aluminium-containing compound appears to work to prevent unwanted decomposition of hydrogen peroxide. This, in turn, is assumed to be due to the fact that the aluminium-containing compound is of a type which together with aluminium contains an alkaline earth metal, such as magnesium, calcium or barium, preferably magnesium, which is normally present in the pulp. In compounds containing magnesium together with aluminium, it is preferred for the molar ratio Mg:Al to be from 3:1 to 6:1. An example of such a compound is hydro-talcite having the general formula $$[Mg_{1-x}Al_x(OH)_2]^{x+}[(CO_3)_{x/2}.nH_2O]^{x-}$$

wherein $0.10<x<0.34$ $n=1-3x/2$.

The structure of hydrotalcite is composed of infinite layers, on the one hand $Mg(OH)_2$ layers where a certain part of $Mg^{2+}$ has been replaced with $Al^{3+}$ and, on the other hand, intermediate layers with $CO_3^{2-}$ and $H_2O$. The amount of carbonate ions corresponds to half the amount of aluminium (in moles) since they constitute a charge equalisation when 2-valent magnesium ions are substituted with 3-valent aluminium ions. The carbonate ions can be replaced with other anions of the type $SO_4^{2-}$.

In the invention, a surprising synergistic action has been found, which means that the filtrate from the washing of the pulp after the peroxide bleaching can contain 50% of remaining hydrogen peroxide or more. Since about 40% of the charged hydrogen peroxide is still necessary for the actual bleaching, this means that the undesirable decomposition of hydrogen peroxide according to the invention is reduced drastically from about 40% to about 10% only.

With a view to further facilitating the understanding of the invention, it will now be elucidated by way of some non-limiting Examples.

EXAMPLE 1

Experiments with the inventive method and according to prior art were carried out in connection with peroxide bleaching of a chemical pulp (sulphate pulp). Before the peroxide bleaching, the pulp had been subjected to treatment with a complexing agent (EDTA) in two steps for removing heavy metal ions. In the experiments, use was made on the one hand of non-treated filtrate from the washing of the pulp after peroxide bleaching and, on the other hand, of filtrate from washing of the pulp after peroxide bleaching which had been treated according to two different methods.

According to one method, which was carried out according to the invention, 1500 ppm aluminium sulphate was added to the filtrate, which originally had a pH of about 10. When adding the aluminium sulphate, the pH was measured and adjusted by means of NaOH to about 5. To accelerate and improve the flocculation of interfering substances, such as COD material, polyacrylamide was also added as a flocculating aid. After removal of the formed precipitate by filtration, the filtrate was added to the pulp which was to be subjected to peroxide bleaching. This method is below referred to as "Method 1".

According to another method, which also was carried out according to the invention, 1500 ppm aluminium sulphate was added to the filtrate, which originally had a pH of about 10. When adding the aluminium sulphate, the pH was measured and adjusted by means of NaOH to about 5. Like in Method 1, polyacrylamide was added as a flocculating aid. After removal of the formed precipitate, the pH of the filtrate was increased to about 7, polya-crylamide was added as a flocculating aid, and a second flocculation and filtration were effected. Subsequently, the resulting filtrate was added to the pulp, which was to be subjected to peroxide bleaching. This method is below referred to as "Method 2". It may be noted that Method 1 corresponds to the first of the two steps in Method 2. By Method 2 comprising precipitation of impurities in two steps, a purer filtrate with less impurities, such as oxygen-demanding organic material (COD), was obtained. The residual amount of aluminium after precipitation and separation according to Method 2 was less than 10 ppm.

In addition to the above filtrate, comparative experiments were also carried out, in which deionised water was used instead of a filtrate from washing of the pulp after peroxide bleaching.

The peroxide bleaching of the pulp was carried out at 90° C. and at a pulp concentration of 12%. For carrying out the bleaching, 50 kg of hydrogen peroxide/ton of pulp was charged. The pulp which had a concentration of 27% by weight and a brightness of 67.9% ISO was diluted to the desired concentration with deionised water, untreated filtrate and, respectively, filtrate which had been treated according to Method 1 or 2 above. The results are shown in Table 1.

TABLE 1

| Experiment No. | Dilution water | Bleaching time (h) | NaOH addition (kg/t) | Final pH | Residual peroxide kg/t | Residual peroxide % of charged | Brightness (% ISO) |
|---|---|---|---|---|---|---|---|
| 1 | Deionised water | 4 | 17 | 10.7 | 16.2 | 32 | 87.2 |
| 2 | Unpurified filtrate | 4 | 17 | 10.S | 8.7 | 16 * | 86.7 |
| 3 | Purified Method 1 | 4 | 19 | 10.7 | 6.6 | 12 * | 82.9 |
| 4 | Purified Method 2 | 4 | 17,6 | 10.4 | 30.3 | 55 * | 85.2 |
| 5 | Deionised water | 16 | 17 | 10.8 | 1.2 | 2 | 89.2 |
| 6 | Purified Method 2 | 16 | 18 | 10.1 | 10.5 | 19 * | 88.6 |

* 5 kg/t extra peroxide added with the dilution water

From the residual peroxide content in Table 1 it is evident that in the invention a significantly improved residual peroxide content is obtained, which is 55% with a bleaching time of 4 h compared with 16% in conventional bleaching (Experiment No. 2) and 32% in bleaching using deionised water as dilution water (Experiment No. 1; i.e. the dilution water contains no metal ions). Correspondingly, the residual peroxide content is in the invention improved to be 19% with a bleaching time of 16 h compared with 2% when using deionised water as dilution water. The improvement according to the invention is achieved at the same or a slightly reduced brightness of the pulp compared with conventional technique using the same bleaching time. The brightness can according to the invention be improved by slightly increasing the bleaching time.

EXAMPLE 2

10–20 g oxygen-bleached softwood sulphate pulp was charged to plastic bags, which after treatment with a complexing agent and washing was diluted to a pulp concentration of 10% with a filtrate from washing of pulp after peroxide bleaching. Sodium hydroxide was added to the filtrate for adjusting the pH for the purpose of adjusting it to be about 10–11. Moreover, hydrogen peroxide in an amount corresponding to 40 kg/ton of pulp was added. An aluminium compound of the type and in the amount stated in Table 2 was also added to some samples. For comparison, no aluminium compound was added to two of the samples. The samples were then allowed to stand for 16 h at a temperature of 90° C., whereupon the remaining hydrogen peroxide content (residual HP) in the sample was measured, as well as the brightness of the pulp. The results are stated in Table 2. It should be pointed out that the samples to which an aluminium compound was added are not according to the invention and instead correspond to a method in which an aluminium compound was added to the filtrate and recirculated to the peroxide bleaching step.

TABLE 2

| Experiment | 1 | 2 | 3 | 4 | 5 | 6 | 7 | 8 | 9 | 10 | 11 | 12 | 13 |
|---|---|---|---|---|---|---|---|---|---|---|---|---|---|
| $H_2O_2$, kg/t | 40 | 40 | 40 | 40 | 40 | 40 | 40 | 40 | 40 | 40 | 40 | 40 | 40 |
| Al, g/t | 0 | 0 | 5 | 25 | 50 | 75 | 150 | 300 | 500 | 75 | 75 | 75 | 75 |
| Al content, ppm | 0 | 0 | 0.6 | 2.8 | 5.6 | 8.3 | 17 | 33 | 56 | 8.3 | 8.3 | 8.3 | 8.3 |
| NaOH, kg/t | 18 | 16 | 18 | 16 | 16 | 16 | 16 | 16 | 16 | 15 | 15 | 15 | 14 |
| Final pH | 11.2 | 11.0 | 11.2 | 11.0 | 11.2 | 11.2 | 10.9 | 10.5 | 10.5 | 10.7 | 10.7 | 10.6 | 10.7 |
| Residual HP, % | 20 | 27 | 11 | 7 | 1 | 0 | 0 | 0 | 0 | 17 | 0 | 2 | 10 |
| Brightness % ISO | 85.9 | 86.5 | 85.6 | 84.2 | 82.4 | 81.9 | 79.6 | 79.5 | 78.5 | 85.6 | 81.5 | 81.6 | 85.2 |

In Experiments 3–9, Al is charged in the form of $AlCl_3$.
In Experiments 10 and 13, the aluminium compound consisted of a polyaluminum sulphate which can be obtained from Kemira Kemi AB, Sweden under the designation UPAS 2005.
In Experiment 11, the aluminum compound consisted of $Al(NO_3)_3$.
In Experiment 12, the aluminium compound consisted of $Al_2(SO_4)_3$.

As appears from the results in Table 2, the remaining hydrogen peroxide content after bleaching is 20–27% with no addition of an aluminium compound. If an aluminium compound is added, the remaining hydrogen peroxide content decreases, whereby an increasing percentage of added aluminium compound results in a successively decreasing percentage of remaining hydrogen peroxide until there is no remaining hydrogen peroxide at all. This may be explained by the fact that aluminium ions from the aluminium compound are replaced with heavy metal ions which are bound in the pulp so that heavy metal ions are released and can have a decomposing effect on the hydrogen peroxide. The reason why the remaining hydrogen peroxide content with the same amount of aluminium compound is higher in Experiments 10 and 13 than in Experiment 6 would be the fact that the aluminium is more strongly bound and has a smaller tendency to be released in the polyaluminium sulphate compared with aluminium chloride.

Summing up, it can be established that it is unsuitable to add aluminium ions to the peroxide bleaching step since this decreases the remaining hydrogen peroxide content. Consequently, in the invention one should essentially add only the amount of aluminium compound that is required for precipitation of interfering substances in the filtrate. Any excess of aluminium in the filtrate should not be present in loosely bound/dissociated form, such as aluminium ions, when the filtrate is recirculated to the peroxide bleaching step.

EXAMPLE 3

In this Example, a further experiment was carried out for the purpose of examining the effect of aluminium on hydrogen peroxide bleaching. In the experiment, use was made of a softwood pulp, which had been withdrawn in a sulphate pulp mill after cooking (raw material 100% sawmill chips), oxygen delignification and treatment with a complexing agent. To remove the remaining heavy metals from the pulp, it was treated with EDTA in an amount of 2 kg EDTA/ton of pulp and was stored at a pulp concentration of about 4–5% by weight for 21 days at room temperature. During this period, the EDTA complexing agent was changed 2–3 times/week by the pulp being filtered, washed once with 4 l of deionised water per 300 g of pulp, whereupon 2 kg EDTA/ton of pulp was again added. After 21 days, a conventional complexing step was carried out by treating the pulp with 2 kg EDTA/ton of pulp for 1 h at 90° C., whereupon the pulp was dewatered and washed. The thus treated pulp could, from a practical point of view, be considered free of interfering heavy metal ions. From the metal-free pulp, two pulp samples were then taken, to which hydrogen peroxide as well as sodium hydroxide for adjusting the pH were charged. Moreover, an aluminium compound in the form of aluminium chloride was charged to one sample. The two samples were bleached for 16 h at 90° C., whereupon the remaining hydrogen peroxide content and the brightness of the samples were determined. The results are stated in Table 3.

TABLE 3

| | | |
|---|---|---|
| $H_2O_2$, kg/t | 40 | 40 |
| NaOH, kg/t | 16 | 16 |
| Al, g/t | — | 75 |
| Final pH | 10.9 | 10.7 |
| Residual HP, % | 13 | 39 |
| Brightness, % ISO | 87.7 | 85.1 |

As appears from the results in Table 3, the metal-free pulp with no addition of aluminium compound exhibited a remaining hydrogen peroxide content of 13% while the pulp to which aluminium chloride had been added quite surprisingly exhibited a remaining hydrogen peroxide content of 39%. In this Example, the pulp was free of interfering metal ions, i.e. the addition of the aluminium compound did not result in heavy metal ions being released from the pulp to act in a decomposing fashion on the hydrogen peroxide, as in Example 2. The great difference in the remaining hydrogen peroxide content cannot be explained with the difference in brightness (2.6% ISO) since this difference corresponds merely to a small difference in the consumption of peroxide. The unexpected increase of the remaining hydrogen peroxide content when adding the aluminium compound must therefore be due to an unexpected effect of the added aluminium compound.

What is claimed is:

1. A method in bleaching of pulp, in which the pulp is subjected to a peroxide bleaching step, whereupon the pulp is washed and the washing liquid from the washing is separated from the pulp in the form of a filtrate, characterised in that the filtrate is treated with an aluminium compound for precipitating interfering substances, that the precipitated material is removed from the filtrate, that the aluminium content of the filtrate after precipitation of interfering substances is at most 20 ppm, and that the filtrate, including an aluminium containing compound which contains an alkaline earth metal, is then recirculated to the peroxide bleaching step.

2. A method as claimed in claim 1, characterised in that the treatment of the filtrate with the aluminium compound is carried out at a temperature in the range 60–100° C.

3. A method as claimed in claim 1, characterised in that the alkaline earth metal is magnesium.

4. A method as claimed in claim 3, characterised in that the molar ration of Mg:Al is from 3:1 to 6:1.

5. A method as claimed in claim 3, characterised in that the aluminium-containing compound is hydrotalcite of the general formula:

$$[Mg_{1-x}Al_x(OH)_2]^{x+}[(CO_3)_{x/2}.nH_2O]^{x-}$$

wherein $0.10<x<0.34$ $n=1-3x/2$.

6. A method as claimed in claim 1, characterised in that the filtrate is treated with an aluminium compound selected from the group consisting of aluminium chloride, aluminium nitrate, aluminium sulphate, polyaluminium chloride, polyaluminium nitrate and polyaluminium sulphate.

7. A method as claimed in claim 1, characterised in that the filtrate is treated with aluminium compound which is added to the filtrate in an amount which is at least sufficient to essentially precipitate the interfering substances.

8. A method as claimed in claim 7, characterised in that the aluminium compound is added to the filtrate in an amount of 1–600 mg Al/l of filtrate.

9. A method as claimed in claim 1, characterised in that the treatment of the filtrate with the aluminium compound is carried out at a pH of 4–11.

* * * * *